US005135790A

United States Patent [19]

Kaplan et al.

[11] Patent Number: 5,135,790

[45] Date of Patent: Aug. 4, 1992

[54] TEAR TAPE OPENING SYSTEM

[75] Inventors: Paul Kaplan, Peapack, N.J.; Thomas C. Steel, Malverne, N.Y.

[73] Assignee: H. B. Fuller Company, St. Paul, Minn.

[21] Appl. No.: 13,373

[22] Filed: Feb. 11, 1987

[51] Int. Cl.[5] ..... B65D 3/26; B32B 3/28

[52] U.S. Cl. ..... 428/77; 428/182; 428/43; 229/238; 229/239

[58] Field of Search ..... 428/40, 43, 77, 182; 229/68 R, 238, 239; 206/604, 605, 608, 609, 610, 611, 612, 630, 634

[56] References Cited

U.S. PATENT DOCUMENTS 901,286 10/1908 Ferres et al. ..... 229/239

4,773,541 9/1988 Riddell ..... 206/606

*Primary Examiner*—Alexander S. Thomas

[57] ABSTRACT

There is provided a tear tape opening system for packages constructed from a tearable substrate such as kraft paper, paperboard or corrugated board materials wherein the resulting tear line is substantially precisely defined with even tearing of the packaging material. The tear tape is adhered along an inside surface of the tearable substrate along the desired tear line of the package and the initiating segment thereof is defined by an opening tab formed at the initiation of the tear line in the package so that it may be grasped by the user to initiate opening. A system for guiding the tear along the desired tear line is provided by means of a guide tape or tapes which serves as an edge reinforcing for the tear lines produced by the tear tape being torn through the packaging material.

3 Claims, 3 Drawing Sheets

TEAR TAPE OPENING SYSTEM

The present invention relates to a tear tape opening system and, more particularly, to a tear tape opening system for use with packaging formed of kraft paper, paperboard and corrugated board materials. More particularly, the present invention relates to a tear tape opening system for use with packages formed of kraft paper, paperboard or corrugated board wherein the tear produced by the tear tape is delineated by the tear tape and is even throughout the length of the tear.

Many consumer items today are packaged by manufacturers in bulk for purposes of transportation and shipment to retailers who thereafter remove the items from the bulk package and place them on display in the retail outlet on counters or shelves for the convenience of the consumer. For the most part, such items are packaged in bulk utilizing packaging materials such as kraft paper, paperboard or corrugated board depending on the strength required by the package. In many cases, and particularly with kraft paper packaging material, no opening feature is provided for the package so that, in order to remove the contents thereof, it is necessary to dismantle the package, which may result in its destruction. In some situations, such as packages formed with paperboard and corrugated board packaging material, an opening feature in the form of score lines which define the desired opening are provided. However, such an opening feature is oftentimes inadequate since the tear resistance of such materials is high resulting in uneven tearing of the packaging material and destruction of the package itself. It is also possible to utilize a sharp object, such as a knife, for the purpose of cutting the packaging material along desired lines. This means, however, is dangerous and can result in injury or damage to the contents of the package and consequent wastage.

As indicated above, bulk packages formed of kraft paper, paperboard or corrugated board containing consumer items are opened and the items removed and positioned on shelves or counters at the retail outlet. This opening of the bulk package and the removal and display of the consumer items is a labor intensive operation which requires a person to physically perform the necessary operations. A great benefit could, therefore, be derived if the bulk package itself could be utilized at the retail outlet as the display device for the consumer units thereby eliminating much of the labor presently necessary for removing the units from the bulk package for display. However, heretofore, this was not possible because, as noted above, the bulk package itself was oftentimes destroyed during the opening process or else, in those situations where an opening feature was provided, this proved to be inadequate.

It is, therefore, a primary object of the present invention to provide an opening system for packages made of packaging materials formed of kraft paper, paperboard or corrugated board and the like wherein the tear line formed during the opening operation is precisely defined and unsightly, uneven tearing of the packaging material is avoided so that the open package itself can thereafter be used for purposes of display, etc. of the consumer product.

The above object, as well as others which will hereinafter become apparent, is accomplished in accordance with the present invention by the provision of a tear tape opening system for packages constructed from kraft paper, paperboard or corrugated board materials. The tear tape is in the form of a hot melt coated tape or string which is adhered along the inside surface of the kraft paper or paperboard packaging material, or which is adhered along a surface of the inside liner of corrugated board packaging material. The tape or string is arranged along the desired tear line of the package and the initiating segment thereof is fixed to an opening tab formed at the initiation of the tear line in the package so that it may be grasped by the user to initiate opening. In order to ensure that the outer surface of the packaging material, i.e. the outer surface of the kraft paper or paperboard material or the outside liner of corrugated board, is evenly torn by the tear tape arranged interiorly of this outer surface, a system for guiding the tear is provided. This guide system comprises two spaced apart parallel tapes adhered to the outer surface of the material and arranged so that the tear tape is disposed within and underlies the space defined between the two parallel tapes. Alternatively, the guiding system may be formed by a single wide tape having no weft or cross machine direction strength adhered along the outer surface of the packaging material so that it overlies the tear tape. In the case of a single tearable substrate, the tear tape and tear guide system can be combined in a single wide tape having no weft strength adhered along the inside surface of the substrate. Also, with corrugated board, it is possible to arrange the guiding tape or tapes on the inside surface of the outside liner and to provide the tear tape on the inside or outside surface of the inside liner.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
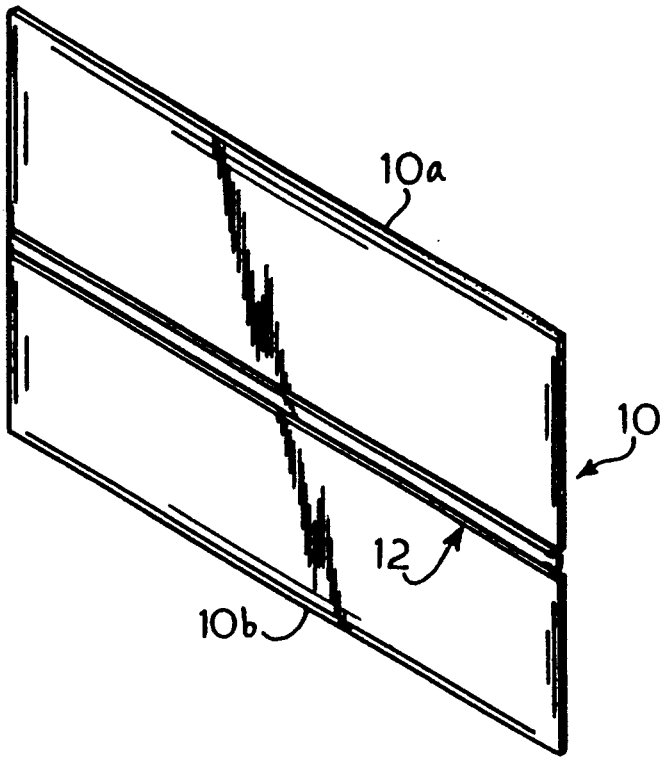
FIG. 1 is a perspective view of a panel of packaging material embodying the tear tape opening system of the present invention.
Figure 2:
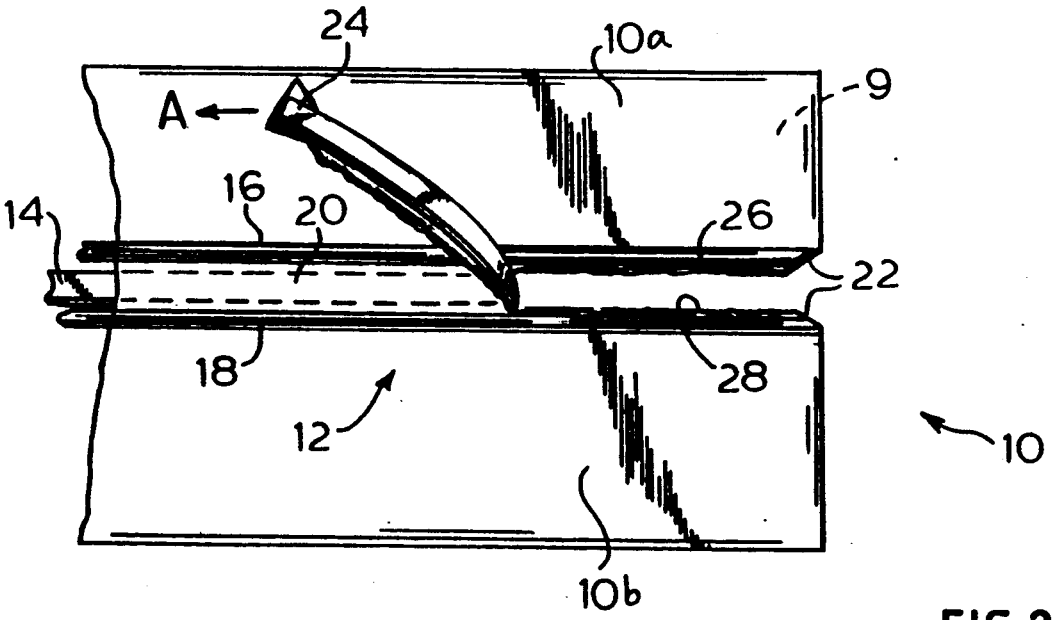
FIG. 2 is a detailed plan view of the operation of the tear tape opening system shown in FIG. 1.

Turning now to the drawings, there is shown in FIG. 1 a panel, designated 10, of a package formed of a packaging material such as kraft paper, paperboard or corrugated board. The package may be a bulk package designed to package a quantity of smaller units. In addition to kraft paper and paperboard, other single tearable substrates may be utilized in connection with the present invention, such as laminations of kraft paper or paperboard, foils, plastics, etc. The tear tape opening system, designated 12, is arranged in panel 10 longitudinally so as to separate the panel into panel segments 10*a* and 10*b* when operated. As clearly seen in FIG. 2, the tear tape, designated 14, is adhered to the inside surface 9 of panel 10 at the desired location of the tear while a tear guide is provided on the outside surface 11 of panel 10. The tear guide is in the form of a tape or tapes and in FIG. 2 comprises parallel narrow guide tapes 16 and 18 which define a tear segment 20 thereinbetween. Tear tape 14 can be anything which has the ability to tear paper, such as a hot melt coated tape or string or a pressure sensitive tape. The tear itself is initiated by means of a die cut 22 which forms an opening or starter tab 24 at the initiating end of tear tape 14. By the application of a pulling force on pull tab 24, as indicated by the arrow A, panel 10 will tear along substantially even tear lines 26 and 28 adjacent guide tapes 16 and 18, respectively. Tear lines 26 and 28 delineate the tear segment 20. Although a single tearable substrate is shown in FIGS. 1 and 2, the same tear tape opening system can also be applied where panel 10 is a laminated substrate, a foil, or plastic material and also where it is a corrugated board. In the case of a corrugated board, tear tape 14 would be adhered to the outside surface of the inside liner of the corrugated board while the narrow guide tapes would be adhered to the outside surface of the outside liner of the corrugated board.

Figure 3:
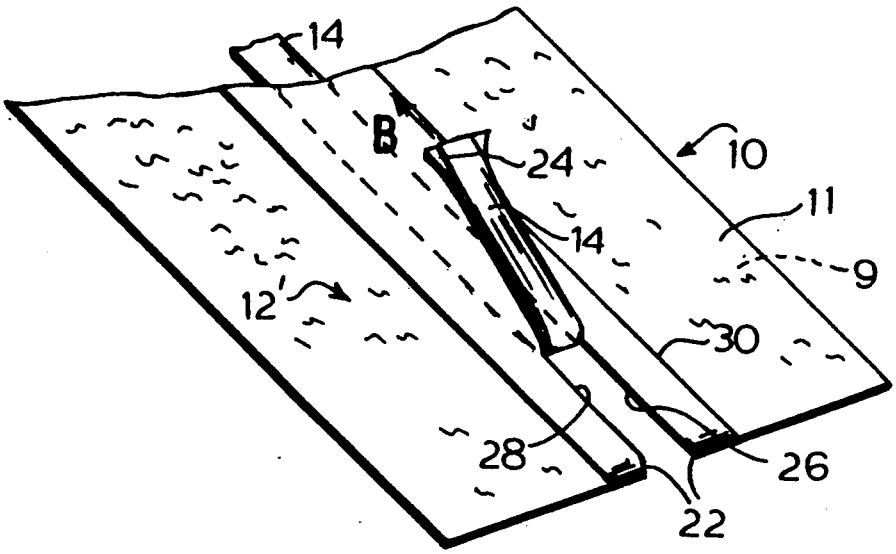
FIG. 3 is a perspective view of the tear tape opening system utilized for kraft paper or paperboard.

Alternatively to the opening system shown in FIGS. 1 and 2 is the opening system 12 shown in FIG. 3 wherein a tear guide along the outside surface 11 of panel 10 is provided by means of a wide tape 30 overlying tear tape 14 so that the packaging material of panel 10 is sandwiched therebetween. Wide tape 30 is adhered to outside surface 11 of panel 10 which is shown to be a single tearable substrate packaging material or which can be a laminated substrate of kraft paper, paperboard, foil or plastic. Guide tape 30 has no weft or cross machine direction strength. This lack of weft strength in guide tape 30 together with strength in the machine direction allows tearing of the guide tape along the tear lines while simultaneously maintaining edge reinforcing therealong. Thus, as clearly seen in FIG. 3, by grasping opening tab 24 formed by die cut 22 and pulling the same in the direction of arrow B, tear tape 14 tears through the material of panel 10 substantially coincident with tear tape 14 and also tears along guide tape 30 which guides the tear and provides edge reinforcing to result in substantially even tear lines 26 and 28.

Figure 4:
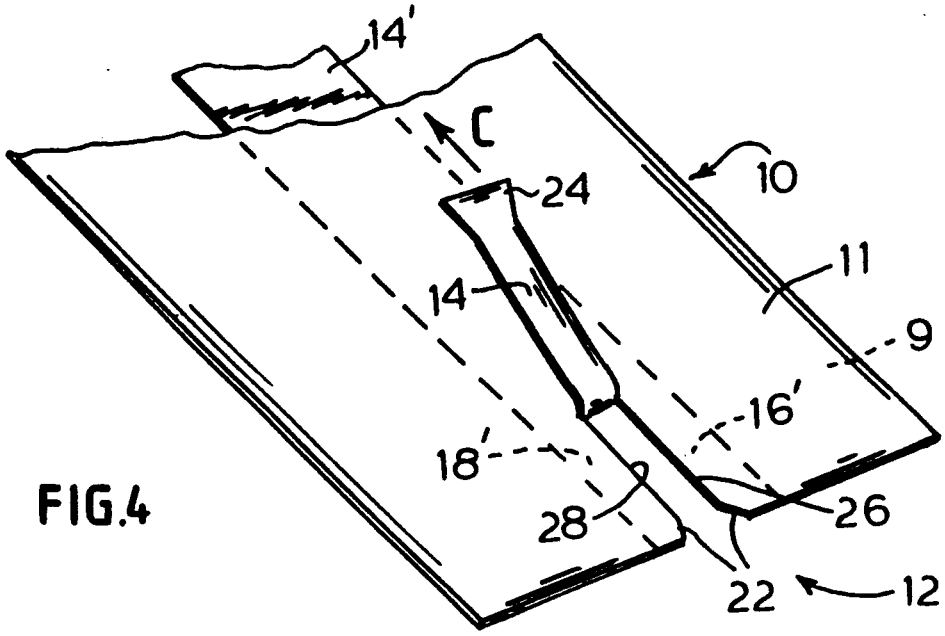
FIG. 4 is a perspective view of an alternative tear tape opening system utilized for kraft paper or paperboard.

Another opening system for a single tearable substrate packaging material or a lamination or foil, etc. is shown in FIG. 4. As shown therein, an opening system 12 includes a wide tape 14′ adhered to the inside surface 9 of panel 10. Tape 14′ has no weft strength or cross machine direction strength and can, therefore, be easily torn in the longitudinal direction. The tear is initiated by means of die cut 22 which forms opening or starter tab 24. By pulling opening tab 24 in the direction indicated by arrow C, tape 14′, because of its lack of weft strength, is torn to form a tear tape 14 and guide tapes 16′ and 18′ on either side thereof. Guide tapes 16′ and 18′ serve to insure that tear lines 26 and 28, respectively, are straight and even by guiding the tear and providing edge reinforcing.

Figure 5:
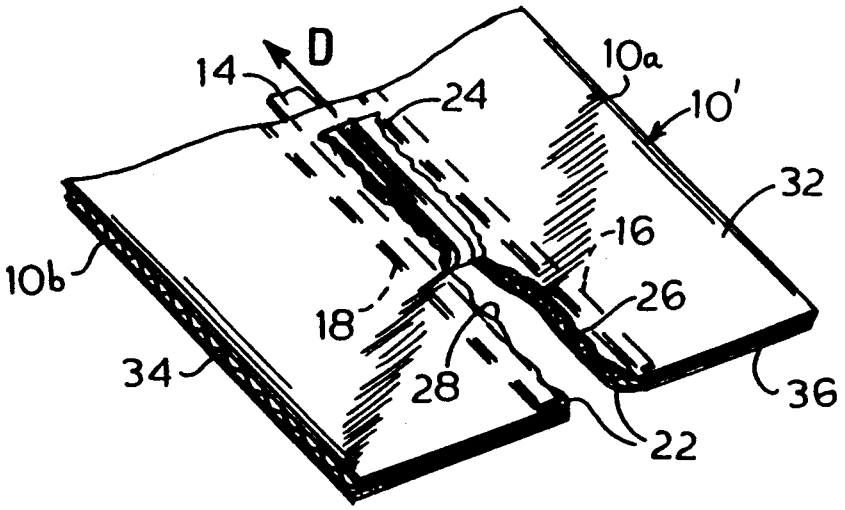
FIG. 5 is a perspective view of the tear tape opening system wherein the parallel tapes of the tear guide are arranged on the inside surface of the outisde liner of the corrugated board packaging material.
Figure 6:
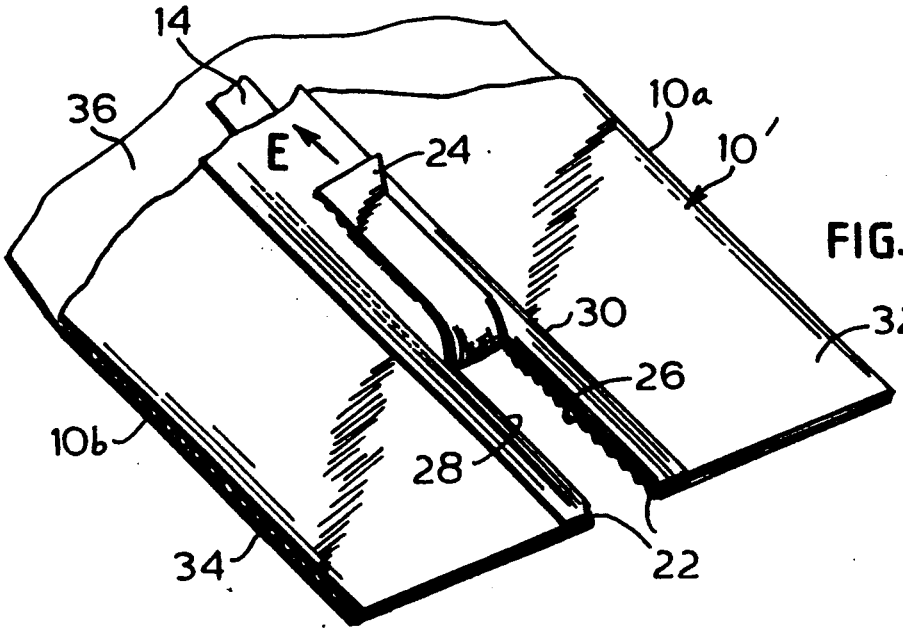
FIG. 6 is a perspective view of the tear tape opening system utilized on corrugated board having a wide tape for guiding the tear on the outside surface of the outside liner.
Figure 7:
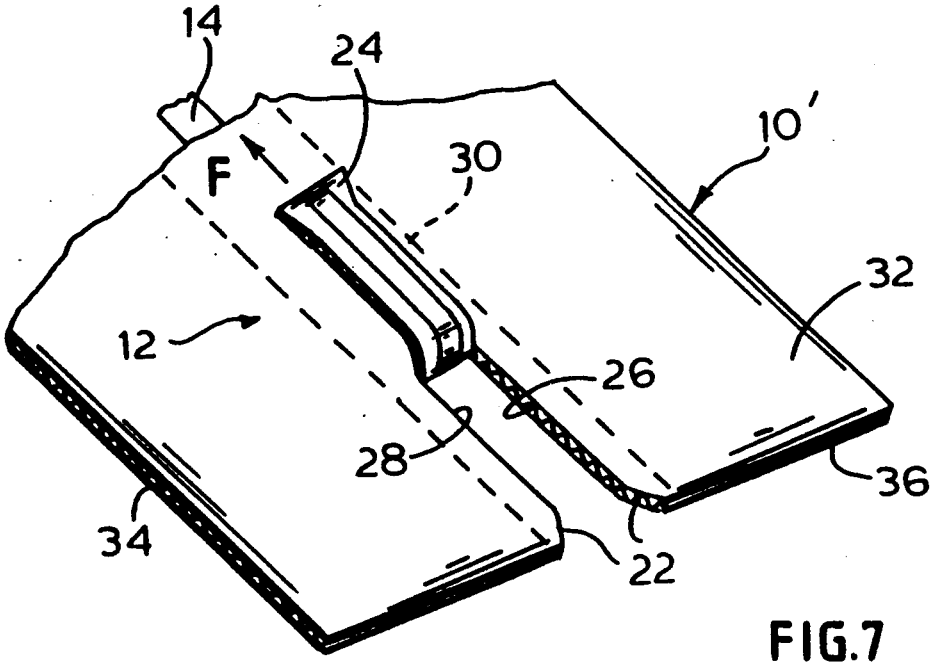
FIG. 7 is a perspective view of the tear tape opening system utilized with corrugated board having the wide tear guide tape arranged on the inside surface of the outside liner.

FIGS. 5, 6 and 7 show variations of the opening system for use with corrugated board as the packaging material. In these figures, corrugated board panel 10′ includes an outside liner 32, an insider liner 36 and corrugations 34. The inside surfaces of outside and inside liners, 32 and 36, are arranged to face corrugations 34. In FIG. 5, narrow guide tapes 16 and 18 are utilized to guide the tear lines 26 and 28, respectively. Narrow guide tapes 16 and 18 are adhered to the inside surface of outside liner 32 of corrugated board panel 10′. Guide tapes 16 and 18 are applied to outside liner 32 during manufacture of the corrugated board. Tear tape 14 is adhered to the outside surface of inside liner 36 of the corrugated board and, by exerting a pulling force in the direction of arrow D on opening tab 24, the tear tape 14 is pulled through the inside and outside liners 36 and 32, respectively, of the corrugated board as well as the corrugations 34 thereinbetween. In FIG. 6, the guiding tape is in the form of a single wide tape 30 adhered to the outside surface of outside liner 32 of corrugated board panel 10′. Tear tape 14 is adhered to the inside surface of inside liner 36 of corrugated board panel 10′. Thus, upon the pulling of pull tab 24 in the direction of arrow E, inside liner 36, corrugations 34 and outside liner 32 are all torn through by tear tape 14 and guide tape 30 guides the tear and serves as a reinforcing edge to ensure that tear lines 26 and 28 are straight and even.

Turning now to FIG. 7, therein is shown a corrugated board panel 10′ having outside and inside liners 32 and 36, respectively, and corrugations 34 thereinbetween. Tear tape 14 is adhered to the outside surface of inside liner 36 while guide tape 30 is adhered to the inside surface of outside liner 32. In order to operate the opening system, the user grasps pull tab 24 formed by die cut 22 and pulls in the direction indicated by the arrow F. Tear tape 14 is thereby caused to rip through inside liner 36, corrugations 34 and outside liner 32. Tear lines 26 and 28 are guided by means of guide tape 30 which, because of its lack of weft strength, causes outside liner 32 to tear substantially evenly, resulting in even tear lines 26 and 28.

It has been found that the cleanest and most even tear lines 26 and 28 are formed when the guide tape or tapes (16–18, 30) are adhered to the top or upper surface of panel 10 or 10′. Although adhering the guide tape or tapes to the inside surface of outside liner 32 of corrugated board panel 10′ is satisfactory, the tear lines 26 and 28 are not precisely even since some tearing, albeit to a slight extent, occurs along the outside surface of top layer 32. Therefore, it is preferable that the guide tape or tapes be adhered to the outside surface of the corrugated board of a package.

While several embodiments of the present invention have been shown and described, it will be obvious that many changes and modifications may be made thereunto without departing from the spirit and scope of the present invention.

What is claimed is:

1. An opening system for creating an opening for a package formed of corrugated board having an outside liner, an inside liner, and corrugations therein between, the outside liner having outside and inside surfaces and the inside liner having outside and inside surfaces, the inside surfaces of said outside and inside liners facing said corrugations, said opening system comprising:

a tear tape adhered to the inside surface of the inside liner along the desired line of opening; and a means for guiding the tear and reinforcing the edges formed by the tear along the outside liner so that the resulting tear line is even, wherein said tear guiding means comprises at least one guide tape adhered to the outside surface of said outside liner.

2. The opening system as defined in claim 1, wherein said at least one guide tape has machine direction strength and no weft or cross machine direction strength and is arranged on the outside surface of the outside liner to overlie said tear tape.

3. The opening system as defined in claim 2, wherein said at least one guide tape is wider than said tear tape.

* * * * *